United States Patent [19]

Fortune

[11] 4,221,356

[45] Sep. 9, 1980

[54] VACUUM OPERATED HOLDING FIXTURE

[76] Inventor: William S. Fortune, 14250 Dearborn St., Panorama City, Calif. 91402

[21] Appl. No.: 959,014

[22] Filed: Nov. 9, 1978

[51] Int. Cl.[2] ..... A45D 42/14

[52] U.S. Cl. ..... 248/363; 269/21

[58] Field of Search ..... 248/362, 363, 206 R; 269/21; 294/64 R, 64 A, 64 B; 355/73

[56] References Cited

U.S. PATENT DOCUMENTS

| | | | |
|---|---|---|---|
| 2,694,337 | 11/1954 | Anander | 355/73 |
| 2,910,265 | 10/1959 | Anander | 248/363 |
| 3,190,460 | 6/1965 | Rubin | 248/362 X |
| 3,307,817 | 3/1967 | Cocito | 248/362 |
| 3,307,819 | 3/1967 | Cocito | 248/363 |
| 3,335,994 | 8/1967 | Cocito | 248/363 |
| 3,460,822 | 8/1969 | Link | 269/21 |
| 3,484,093 | 12/1969 | Mermelstein | 269/21 |
| 3,602,543 | 8/1971 | Sjodin | 294/64 R |
| 3,720,433 | 3/1973 | Rosfelder | 294/64 R |
| 4,089,603 | 5/1978 | Jacobs | 248/363 X |

*Primary Examiner*—J. Franklin Foss

*Attorney, Agent, or Firm*—Daniel T. Anderson

[57] ABSTRACT

A holding fixture is operated by vacuum and consists of a plurality of suction assemblies mounted on a carrier. Each suction assembly forms an independent unit and operates as an automatic valve to disconnect itself from a common vacuum source when the vacuum is broken. To this end each suction assembly is mounted on a common carrier and disposed in a hollow chamber. It includes a flexible member capable of being sucked into the chamber by a pressure differential thereacross to disconnect the particular assembly from the vacuum. The sealing means may consist of a suction cup or O-rings. The movable member may consist of a flexible plastic or a movable disk.

4 Claims, 5 Drawing Figures

VACUUM OPERATED HOLDING FIXTURE

BACKGROUND OF THE INVENTION

This invention relates generally to removable holding fixtures and particularly relates to a holding fixture of the type operated by a vacuum.

In Applicant's prior U.S. Pat. No. 4,056,334 a holding fixture of the vacuum operated type has been disclosed and described in FIGS. 6–9. It has been found that this holding fixture operates very well on solid flat surfaces such as a worktable.

However, in some cases a work bench or the like is covered with a formica sheet such, for example, as a low static or conductive polyethylene which will leak off electricity. A sheet of this type has the consistency of linoleum.

It has been found that the holding fixture of Applicant's prior patent above referred to, will not hold on such surfaces. The reason is that the fixture utilizes a single, large vacuum region and application of the vacuum to this region under the holding fixture will suck up the plastic sheet. Subsequently the sheet wrinkles and any wrinkles at the periphery of the vacuum region break the entire vacuum holding effect under the fixture. The situation becomes more aggravated in time because eventually the plastic sheet forms permanent wrinkles and the vacuum more readily pulls up the sheet, thus more rapidly destroying the vacuum.

It is accordingly an object of the present invention to provide a holding fixture characterized by a plurality of suction assemblies, each being independent of the other and each operating as an automatic valve.

Another object of the present invention is to provide a holding fixture which is simple in construction, reliable in operation and inexpensive to manufacture.

SUMMARY OF THE INVENTION

Briefly these and other objects are achieved in accordance with the structural aspects of an example of the invention which includes either a plurality of suction cups or a plurality of pistons movable in respective chambers. Thus the vacuum operated holding fixture of the invention comprises a common barrier, a plurality of suction assemblies mounted on the carrier and a common source of vacuum. The carrier is formed with an individual hollow chamber for each assembly. All of the chambers are connectable at will to the vacuum source. This connection includes a conduit to each chamber.

Each assembly includes a movable member such as a suction cup or piston. The movable member is capable of moving into its associated chamber upon the application of a pressure differential thereacross. Thus when the outside of the movable member is exposed to atmospheric pressure and the chamber to a vacuum, the movable member is sucked inwardly into the chamber. Each movable member is capable of being sealed to a surface such as a workbench. This may be accomplished by a suction cup or an O-ring. Each of the movable members has an opening therethrough into the associated chamber.

Hence when the vacuum below one of the assemblies is broken the movable member moves into its chamber and blocks the connection between the chamber and the ambient air so that the vacuum in the remaining assemblies will be maintained.

The novel features that are considered characteristic of this invention are set forth with particularity in the appended claims. The invention itself, however, both as to its organization and method of operation, as well as additional objects and advantages thereof, will best be understood from the following description when read in connection with the accompanying drawings.

DESCRIPTION OF THE PREFERRED EMBODIMENTS

Figure 1:
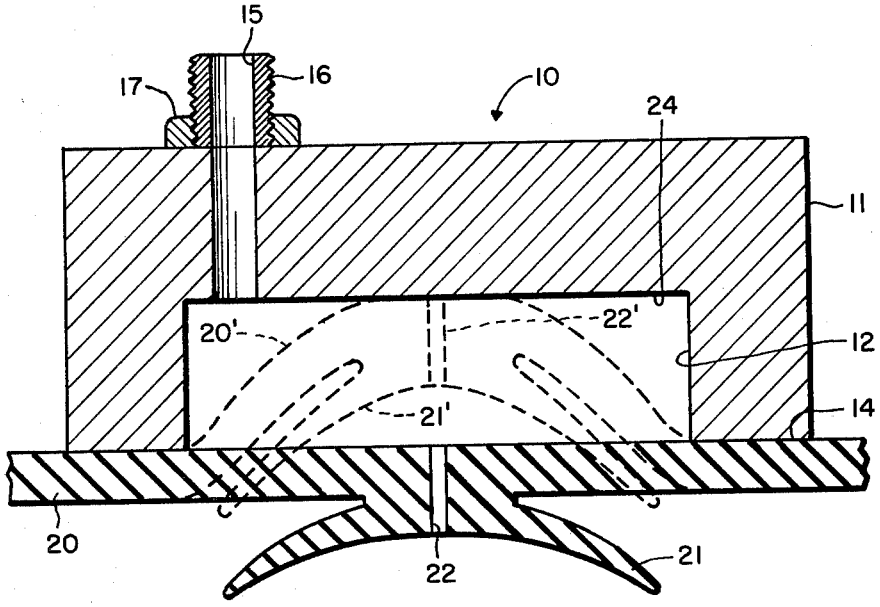
FIG. 1 is an enlarged cross-sectional view of one of the suction assemblies featuring a suction cup.

Referring now to FIG. 1, there is illustrated by way of example, a preferred embodiment of the present invention represented by a single suction assembly 10. The assembly 10 includes a carrier 11 which may, for example, consist of metal or a suitable plastic which may even be flexible. The carrier 11 is formed with a hollow chamber 12 therein which in turn is open at the bottom surface 14 of the carrier 11. An aperture 15 extends through the carrier 11 and is connectable by a threaded nipple 16 and a nut 17 to a common source of vacuum. Such a vacuum source may, for example, consist of the vacuum pump illustrated and described in connection with FIGS. 1 and 2 of Applicant's patent previously referred to.

The carrier 11 is closed by a flexible member 20 which may, for example, have the shape of a flexible sheet. It is terminated in a suction cup 21 through which an opening 22 extends into the chamber 12.

The operation of the assembly of FIG. 1 will now be described. When a vacuum is applied through the threaded nipple 16 into the chamber 12 the suction cup 21 is secured to and held by a flat surface. The air between the flat surface and the suction cup 21 is sucked into and through the opening 22 and the conduit 15. The holding fixture is now held to a flat surface such as a workbench.

Assuming, however, that for any reason the vacuum is broken because the suction cup 21 is partially lifted off the surface, then the ambient air will be sucked in past the suction cup 21 into the opening 22 and so on. As a result a differential pressure exists between the flexible sheet 20, the suction cup 21 and the chamber 12. This differential pressure is defined by the ambient air acting on the sheet 20 and the suction cup 21 and the vacuum of reduced pressure in the chamber 12. This will now suck the sheet 20 and suction cup 21 into the chamber 12 into the position shown in dotted lines at 20' and 21'. It will now be seen that the portion of the sheet 20 surrounding the opening 22 has been sucked against the top wall 24 of the chamber 12 thus blocking the conduit 15 from the ambient air.

Hence it will be evident that the assembly of FIG. 1 operates as an automatic valve which disconnects the vacuum source from any suction cup or assembly where the vacuum has been broken.

Figure 2:
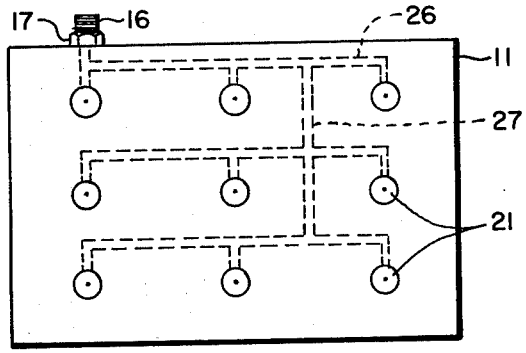
FIG. 2 is a plan view of a plurality of such suction assemblies mounted on a common carrier and showing the interconnections between individual chambers thereof.

FIG. 2 illustrates a plurality of suction cups 21 on a single carrier 11. Each of the suction cups 21 is connected to a common nipple 16 and nut 17 through conduits 26, 27 etc. whereby the chamber of each suction cup is individually connected to the common vacuum source.

Figure 3:
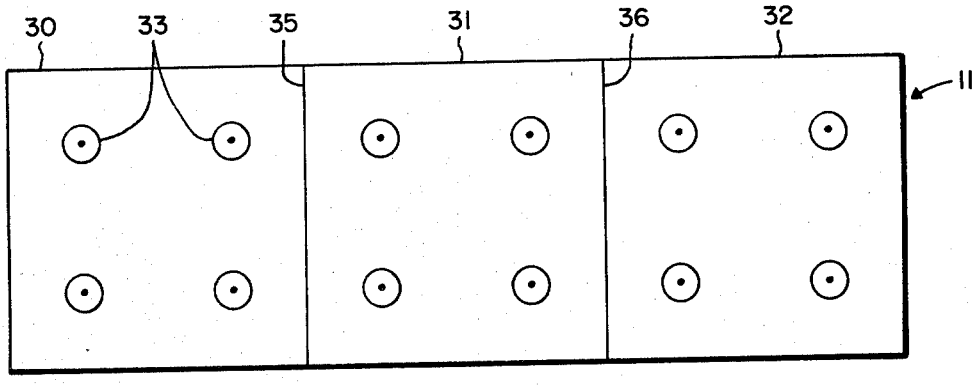
FIG. 3 is a plan view similar to that of FIG. 2 and showing a holding fixture including a plurality of sections which may be either flexible or hinged.

FIG. 3 illustrates another modification of the holding fixture of the invention. Here the common carrier 11 is subdivided into a plurality of sections 30, 31 and 32, each carrying, for example, four suction assemblies or suction cups 33. The interconnections between the individual chambers of each suction cup have not been illustrated to avoid confusion.

The common carrier 11 of FIG. 3 may either consist of a flexible plastic or else between each pair of sections 30, 31 and 31, 32 there may be a hinge-like connection shown at 35 and 36.

It will now be seen that the holding fixture of FIG. 3 may accommodate itself to a curved surface or the like because either the common carrier is flexible or individual sections are hinged to each other.

It will, of course, be understood that the actual holding fixture such as shown in FIG. 6 of Applicant's patent has not been illustrated. It will be evident that such a holding fixture may be mounted on the structures of FIGS. 2 and 3, that is on the carrier 11. It should be noted that the flexible sheet 20 and suction cup 21 may consist of rubber or synthetic rubber such as shell rubber or polyurethane rubber. The carrier 11 may consist of metal or plastic except in the case of FIG. 3 where it preferably consists of flexible rubber.

It will now be seen that the holding fixture has a plurality of suction assemblies, each of which operates independently on the others. Each suction assembly provides an automatic shut-off valve to disconnect it from the vacuum supply. The structure may be made flexible to follow a curved surface or it may be made flexible in sections like a chain.

Figure 4:
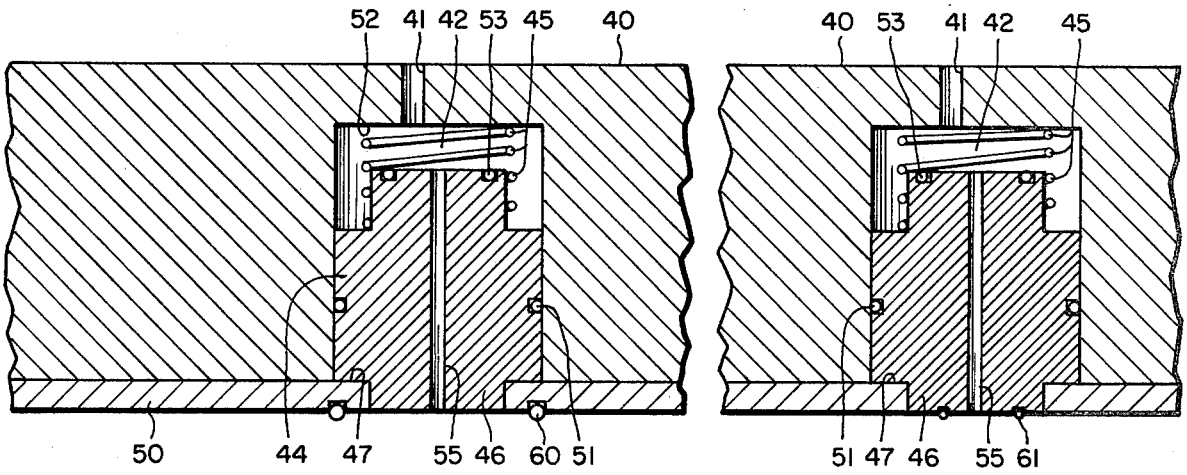
FIG. 4 is a cross-sectional view on enlarged scale of another type of suction assembly including a spring biased movable piston.
Figure 5:
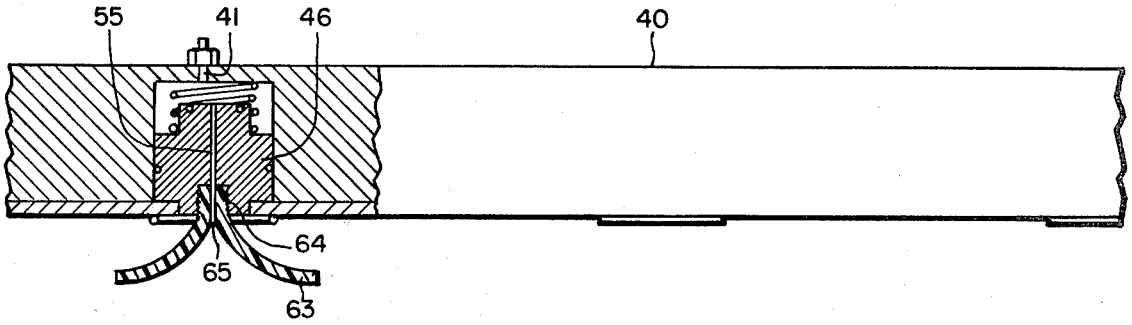
FIG. 5 is a side elevational view partly in section of a plurality of assemblies of the type of FIG. 4 and provided with an apertured suction cup.

Referring now to FIGS. 4 and 5, there is illustrated another embodiment of the present invention of a vacuum operated holding fixture. As shown in FIG. 4, there is provided a common carrier 40 provided with an opening 41 for connection to a vacuum source. The carrier 40 is provided with a cylindrical internal chamber 42. A movable piston 44 is disposed in the chamber 42. The piston is urged by a spring 45 outwardly of the chamber 42 and may have a reduced portion 46 about which the spring 45 extends. The piston is retained by a shoulder 47 formed on a bottom sheet 50 which may be made integral with the carrier 40. The walls of the piston 44 are sealed by an O-ring 51 and the top of the piston 44 is sealed with respect to the top wall 52 of the chamber 42 by an O-ring 53.

An opening or channel 55 extends through the piston 46 to the ambient air. The bottom sheet 50 may be sealed by an O-ring 60.

As shown in the right-hand half of FIG. 4, instead of providing an O-ring 60 about the piston 46 it is also feasible to provide an O-ring 61 at the outer surface of the piston 46.

The operation of the piston-type holding fixture of FIG. 4 will now be explained. The piston 44 is urged by the spring 45 outwardly against the shoulder 47. Either the O-ring 60 or the O-ring 61 will seal the piston to a flat surface. However, if the vacuum should be broken the piston 46 will move upwardly toward the wall 52 of the chamber 42. This in turn will seal the conduit 41 to the vacuum source by the O-ring 53.

The structure of FIG. 5 shows a slight modification of that of FIG. 4. Instead of providing O-ring 60 or 61 either to the piston 46 or about the piston it is also feasible to apply a suction cup 63 to the piston which may, for example, be connected thereto by an externally threaded plug 64 which is threadably connected to an internal thread of the piston 46. The channel 55 through the piston 46 extends through the suction cup 63 as shown as 65.

It should be noted that the vacuum supply may, for example, be applied by a three-way valve of the type disclosed and claimed in FIGS. 7–9 of Applicant's copending application Ser. No. 875,569 filed Feb. 6, 1978.

There has thus been disclosed a vacuum operated holding fixture which features a plurality of independent suction assemblies. Each of the suction assemblies operates as an automatic shut-off valve in case the vacuum is broken. The arrangement may be such that the suction assemblies are mounted on a flexible carrier, or on a hinged carrier so that the fixture may be mounted on a curved surface. The loss of the vacuum to one of the suction assemblies will not impede the operation of the device.

I claim:

1. A vacuum operated holding fixture comprising:

(a) a common carrier;

(b) a plurality of suction assemblies mounted on said carrier;

(c) a common source of vacuum;

(d) said carrier being formed with an individual hollow, outwardly open chamber having a substantially flat roof surface for each of said assemblies;

(e) means for connecting at will all of said chambers to said source and including a closable conduit to each of said chambers;

(f) each of said assemblies including a flexible member extending across the outwardly open portion of its associated chamber and capable of stretching into its associated chamber upon the application of a pressure differential thereacross;

(g) each of said members having an opening therethrough into its associated chamber; and (h) each of said members having a suction cup provided with an opening for sealing it substantially vacuum tight to a surface, whereby each suction cup will attached itself to a surface upon the application of a vacuum from said source, and whereby said suction cup will normally hold the vacuum and when said suction cup becomes open to the atmosphere, said flexible member will flex inwardly into its associated chamber thereby to seal said openings by pressing against said roof surface of its chamber to operate as an automatic valve.

2. A holding fixture as defined in claim 1 wherein said flexible member is a single flexible sheet of a plastic material extending across the open end portions of a plurality of said chambers.

3. A holding fixture as defined in claim 2 wherein said suction cup is formed integral with said flexible sheet.

4. A holding fixture as defined in claim 1 wherein said flexible member will form a substantially air-tight seal with said roof surface when said suction cup becomes open to the atmosphere.

* * * * *